US005355593A

United States Patent [19]

Kotitschke

[11] Patent Number: 5,355,593

[45] Date of Patent: Oct. 18, 1994

[54] DEVICE FOR TRANSFERRING A FIBER WEB

[75] Inventor: Gerhard Kotitschke, Steinheim, Fed. Rep. of Germany

[73] Assignee: J.M. Voith GmbH, Heidenheim, Fed. Rep. of Germany

[21] Appl. No.: 78,375

[22] Filed: Jun. 17, 1993

Related U.S. Application Data

[63] Continuation-in-part of Ser. No. 931,265, Aug. 17, 1992, abandoned.

[30] Foreign Application Priority Data

Jun. 24, 1992 [DE] Fed. Rep. of Germany ..... 4220682

[51] Int. Cl.[5] ..... D06F 58/00

[52] U.S. Cl. ..... 34/117; 34/120; 34/121

[58] Field of Search ..... 34/116, 117, 114, 120, 34/25, 52, 113, 118, 121, 123; 162/206, 207

[56] References Cited

U.S. PATENT DOCUMENTS 4,677,763 7/1987 Kotitschke et al. ..... 34/116

4,768,294 9/1988 Weideburg ..... 34/116

*Primary Examiner*—Denise Gromada

*Attorney, Agent, or Firm*—Ostrolenk, Faber, Gerb & Soffen-

[57] ABSTRACT

A device for transferring a paper web from the press section into the dry end of a paper making machine. The web contacts a rotatable press surface, e.g. on a press roll, and travels with the press surface through a press nip against a backing roll, and thereafter travels with the press surface to a web removal place. The web is transferred by a suction device across an adjustable gap to a porous transport belt which transports the web toward a first dryer group. The first dryer group has a number of drying cylinders and a web support belt that transfers the web from drying cylinder to drying cylinder. Either a suction device or another intermediate transfer roll transfers the web from the transport belt to the support belt for the dryer group. An adjustable speed control device operates the drive to the press surface, the drive to the transport belt and the drive to the first group of drying cylinders and their respective support belt so that there is a positive difference in speed between the web at the press nip and the speed of the web at the transport belt with the web moving faster at the transport belt and a positive difference in speed between the speed of the transport belt and the speed of the web support belt with the web moving faster on the support belt.

38 Claims, 6 Drawing Sheets

Fig. 5
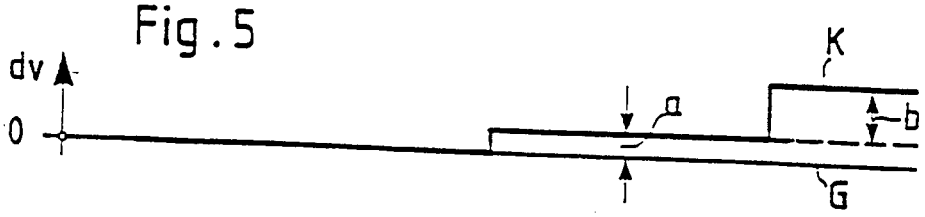
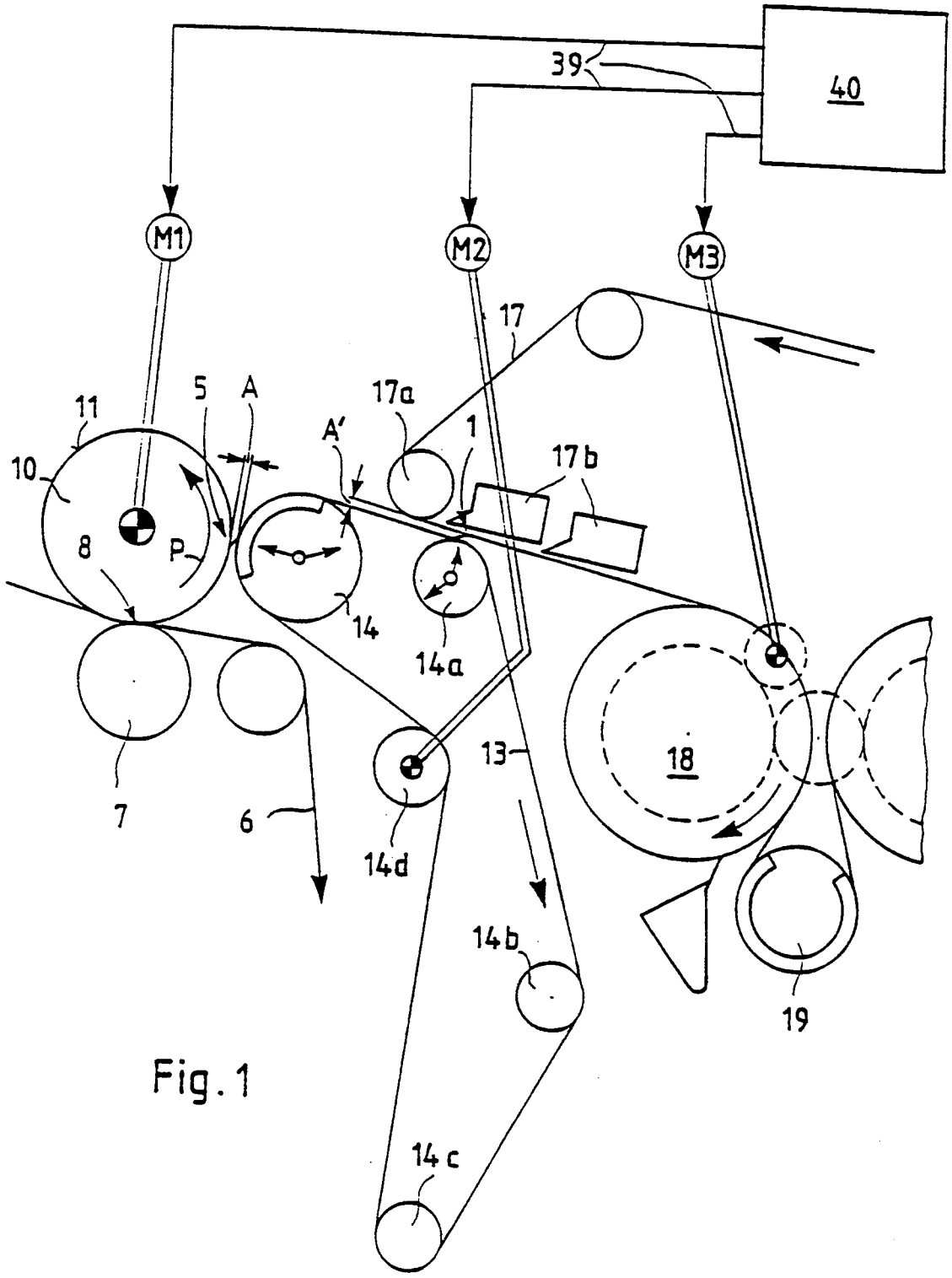
Fig. 1

13
M2
14d
6
73
7
64
70
74
61
71
72
60
62
67
65
5
10
75
68
66
18
69
63
A
M1
14G
16
1
M3
19
M2'

DEVICE FOR TRANSFERRING A FIBER WEB

CROSS-REFERENCE TO RELATED APPLICATION

This is a continuation-in-part of U.S. Ser. No. 07/931,265 filed Aug. 17, 1992, now abandoned.

BACKGROUND OF THE INVENTION

The present invention relates to a device for transferring a fiber web, particularly a paper web, from the press section into the dry end of a paper manufacturing machine. The invention proceeds from a device in accordance with Federal Republic of Germany Patent 35 44 541, which corresponds to U.S. Pat. No. 4,768,294.

In this known device, the web travels in direct contact with the smooth shell of a press roll. Downstream of the press nip, the web continues its travel in contact with the shell of the press roll up to a place where the web detaches from the roll. There it is transferred onto a porous transport belt which travels over a guide roll arranged close to the press roll and over a drying cylinder which is arranged within the loop of the transport belt. The support belt of the following first dryer group is tangent to the circumference of the aforementioned drying cylinder and takes over the further transport of the web.

It is known to provide a first drive for the press roll, a second drive for the transport belt, and a third drive for the first dryer group. The speeds of these drives are controlled independently of one another. A positive speed differential of the second drive as compared with the first drive and also of the third drive with respect to the second drive can be established so that controllable elongation of the web takes place at both points of transfer.

One disadvantage of the known device is that the web must pass over a relatively long unsupported free path or open draw between the smooth press roll and the porous transport belt. There is thus the danger that the web, which is still moist, may travel unevenly at this place. In particular, the edges of the web tend to flutter. This can result in tearing of the web, although, as stated above, the web is stretched relatively little at this place. Another disadvantage is that the first drying cylinder is arranged within the loop of the transport belt so that the web does not come into contact with this cylinder. Substantial heating of the web therefore commences only at the second drying cylinder of the upper row of cylinders. Therefore, this known construction has not been introduced into actual practice.

In customary arrangements, there is no transport belt between the press section and the dry end. Therefore, the support belt of the first dryer group is brought by means of a guide roll, which may be a suction roll, as close as possible to the shell of the smooth press roll, as shown in Federal Republic of Germany Patent 33 44 217, which is equivalent to U.S. Pat. No. 4,677,763. The paper web travels from the smooth press roll over a relatively short free path of travel or open draw directly to the support belt. As an alternative, a paper guide roll is provided between the smooth press roll and the support belt if the smooth press roll does not come into contact with the bottom side of the web but instead contacts its top side.

These known arrangements have proven satisfactory in practice. However, difficulties have recently been encountered in increasing the operating speed of such a paper manufacturing machine to the desired extent and at the same time to sufficiently tension the paper web upon its introduction into the dry end. This initial tensioning is effected, as is known, by establishing a speed difference between the first dryer group and the smooth press roll. It has been found that establishing a relatively great difference in speed makes it necessary to provide a relatively great distance between the smooth press roll and the support belt. However, the danger of the fluttering of the edges of the web arises again. On the other hand, if that distance is made relatively small, to avoid the fluttering of the edges of the web, only a relatively small difference in speed can be established or else the paper web must be stretched strongly over a short distance, which may lead to tears in the web even in the event of only the slightest defects in the paper.

SUMMARY OF THE INVENTION

It is an object of the present invention to provide a device for the transfer of a web from the press section into the dry end so that the following requirements, which up to now have been contradictory, can be simultaneously satisfied:

1. The length of the free path of travel of the web should be as small as possible in order to obtain quiet non-fluttering travel of the web even at extremely high operating speeds.

2. At the same time, it should be possible to provide the web with a relatively high initial tension in its longitudinal direction upon introduction of the web into the first dryer group of the dry end.

These objects are achieved by the combination of the invention. The invention proceeds from the disclosure of Federal Republic of Germany Patent 35 44 541. In accordance with the invention, only a very small difference in speed is adjustable between the second drive for the drive for the transport belt and the first drive for the drive for the smooth press element. Therefore, the transport belt travels faster than the smooth press element by a very small amount. In this way, only that longitudinal tension necessary to pull the web off the smooth press element is produced in the paper web. The exact amount of this speed difference depends on various factors, for instance, the type of paper, the material of which the smooth press element is made and/or the moisture content still present in the web of paper. In all cases, the very small difference in speed provides the advantage that the length of the free path of travel of the web can be greatly reduced at the place of web removal where the web transfers from the smooth press element to the transport belt. In at least one embodiment of the invention, this distance can even be made equal to zero. In this way, the fluttering of the web is avoided and the danger of tears is reduced.

At the same time, according to the invention, a relatively large difference in speed can be established between the third drive for the first dryer group and particularly its web support belt, and the second drive for the transport belt. In this way, the paper web can be so pre-tensioned in its longitudinal direction upon its introduction into the first dryer group and thus stretched that the web of paper is guided by the support belt more dependably on the drying cylinders with which it comes into contact than was previously the case. Generally, the web stays on the surface of each drying cylinder for a short distance after its support belt or dryer wire separates from the cylinder and then the web rejoins that support belt. This produces a "bubble" in the web. As a result of use of the invention, at the place of removal of the web from each drying cylinder, the web of paper follows the support belt at an earlier time than was previously the case. In other words, the "bubble" which forms at this place between the web of paper and the support belt or drying wire is substantially smaller than before. Thus, the danger of the web of paper tearing at this place also is substantially reduced.

This advantageous effect contributes to the possibility of bringing the paper web much earlier into contact with the first drying cylinder than in the case of Federal Republic of Germany '541, i.e., it is no longer necessary to arrange the first drying cylinder within the loop of the transport belt. In this way, transfer of heat through the transport belt is avoided. The web can be heated with less expenditure of energy, since the web comes into direct contact with the first drying cylinder, as is known from Federal Republic of Germany '217.

Other features and advantages of the present invention will become apparent from the following description of the invention which refers to the accompanying drawings.

BRIEF DESCRIPTION OF THE DRAWINGS

FIG. 1 diagrammatically shows a device for transferring a web from the press section to the dry end of a paper manufacturing machine;

FIG. 5 shows a speed diagram referring to FIGS. 1, 2 and 3;

DETAILED DESCRIPTION OF EMBODIMENTS OF THE INVENTION

Figure 2:
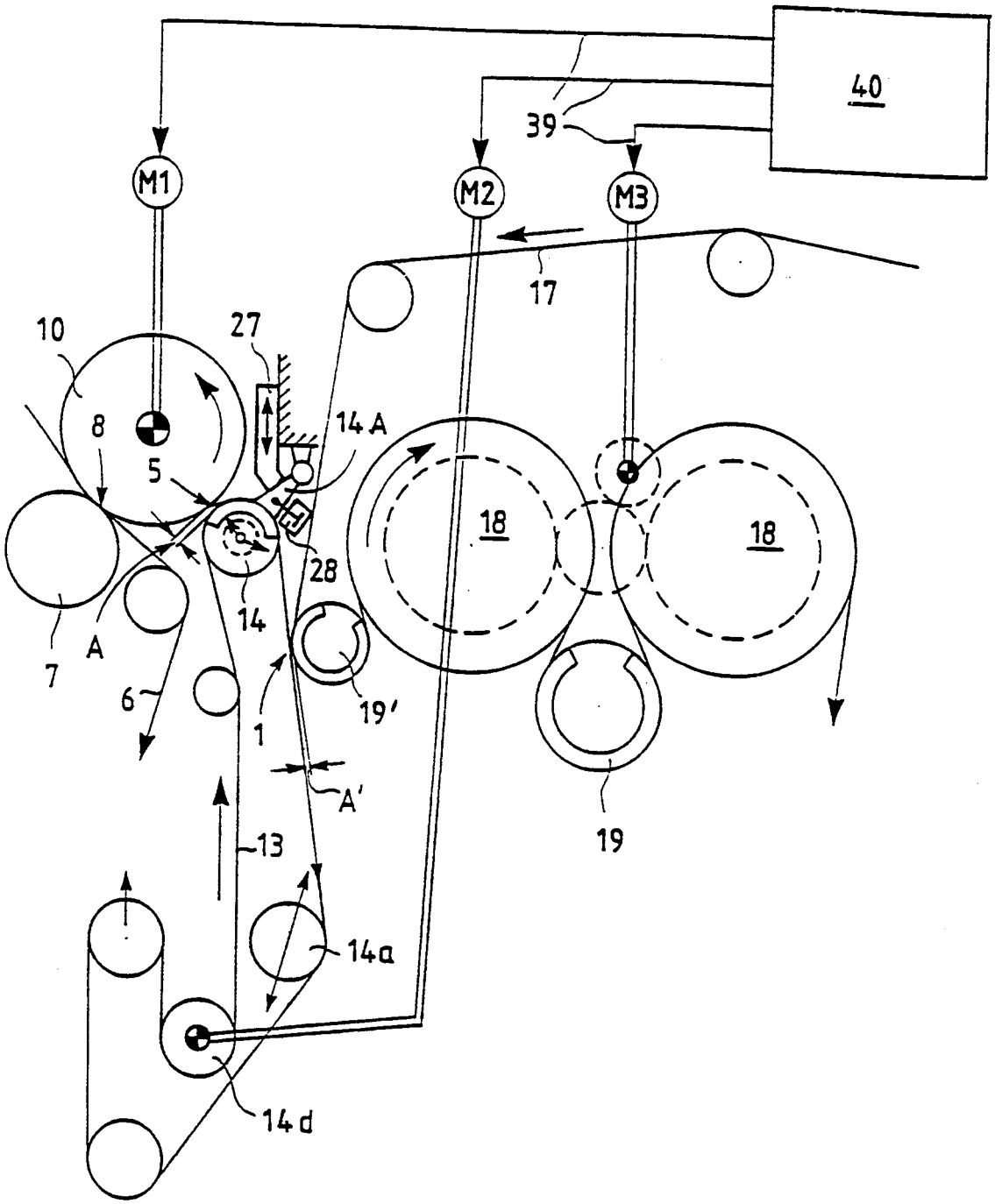
FIG. 2 shows a modification of FIG. 1. In both FIG. 1 and FIG. 2, the top of the web comes into contact with a smooth press roll.

In the device shown in FIG. 1, an upper press roll 10 and a lower backing roll 7 form a press nip 8 through which a web to be dewatered travels, together with a web dewatering felt belt 6. The web comes into contact with a press surface, namely here with the smooth surface 11 of the press roll 10. The roll 10 is, for instance, a stone roll made of natural granite or it is a metal roll, preferably with a plastic covering. In all cases, the smooth surface 11 of the press roll is so shaped that the fiber web, which is still moist, adheres with the slightest possible force of adhesion to the smooth surface after passing through the press nip 8. Accordingly, relatively little pull is necessary in order to detach the web from the smooth surface 11 later during the rotation path of the surface 11. The direction of rotation of the press roll 10 is designated by an arrow P. The fiber web, therefore, travels upward after leaving the press nip 8 and in the direction toward the place of removal 5. There, a porous transport belt 13 moves, at a slight distance A away, past the smooth surface 11 of the press roll. The transport belt 13 is supported there by a suction guide roll 14. From there, the transport belt 13 passes over additional guide rolls 14*a*, 14*b*, 14*c* and 14*d*. On the path from the suction guide roll 14 to the guide roll 14*a*, the transport belt 13 comes, together with the paper web, into the region of the path of travel of an endless web support belt 17. The belt 17 is part of a first dryer group. The support belt 17 brings the web of paper into contact with drying cylinders 18. The support belt together with the web travels in a meander path alternately over a drying cylinder, then over a reversal suction roll 19 which lies within the loop of the support belt, then over the next drying cylinder, etc. Instead of the reversal suction rolls 19, simple guide rolls or guide rolls provided with circumferential grooves or else, as in Federal Republic of Germany Patent 35 44 541, additional drying cylinders can also be provided.

Also diagrammatically shown in FIG. 1, the press roll 10 is coupled to a first drive M1. One of the guide rolls 14*a*–14*d* of the transport belt 13 is coupled to a second drive M2. Finally, the dryer group 17–19 has a third drive M3. Each of these drives M1–M3 is connected via a system of lines 39 to a speed control device 40, by which the speed of each individual drive can be controlled in a known manner. The diagram in FIG. 5 corresponding to FIG. 1 contains a characteristic line K. This is the speed difference dv which can be adjusted between the drives M1, M2 and M3. Thus, the vertical distance a of the characteristic line K from the base line G shows that the speed of the second drive M2 is greater than the speed of the first drive M1 by a small amount. It can further be seen that the speed of the third drive M3 is greater by a relatively large amount b than the speed of the second drive M2.

The distance A or shortest length of the gap between the smooth surface 11 of the press roll 10 and the transport belt 13 on the roll 14 is set to the smallest possible value, of a few millimeters. The optimal size of this distance A must be determined by experiment. Therefore, the position of the suction guide roll 14 is variable, as indicated diagrammatically by a double-ended arrow. In the extreme case, the distance A is only approximately equal to the thickness of the transport belt 13. In a similar manner, the distance A' of the gap between the transport belt 13 and the support belt 17 at the web transfer place 1 can be varied in order to optimize the transfer of the web, for instance by displacing the guide roll 14*a*. This distance A' can amount to a few millimeters or even be equal to zero. It is advisable that, shortly upstream or in front, with respect to the direction of travel, of the guide roll 14*a* lying within the loop of the transport belt, the support belt 17 travels over a guide roll 17*a* which lies within the loop of the support belt. The boundary air layer which is transported by the inner side of the transport belt 13 to the guide roll 14*a* may be sufficient to detach the web from the transport belt at the guide roll 14*a* and deflect it to the support belt 17. In addition, in order to increase the reliability of operation, a suction device, for instance in the form of transfer foils 17*b*, can be arranged within the loop of the support belt.

The embodiment shown in FIG. 2 differs only in a few details from the embodiment shown in FIG. 1. The path of travel of the transport belt 13 from the suction guide roll 14 to the following guide roll 14*a* is not, as in FIG. 1, substantially horizontal but, rather, extends essentially vertically downward. The transport belt 13 on this travel path is tangent to a first reversal suction roll 19' which reverses the web support belt of the dry end coming from above and feeds that belt in an upward direction to the first drying cylinder 18. The reversal suction roll 19' acts as a web pick-up roll. The distance A' shown between the transport belt 13 and the reversal suction roll 19', at the web transfer place 1, amounts to only a few millimeters. It may even be equal to zero. One advantage of this arrangement is that the zone of contact, i.e. the angle of wrap, of the paper web on the first drying cylinder 18 is substantially greater than in FIG. 1. The suction guide roll 14 is mounted on a swing lever 14A which is pressed against a stop 27 by means of a pneumatic cylinder 28. The stop 27 is adjustable so that the distance A between the press roll 10 and the suction guide roll 14 can be set precisely to a small value. During threading of the web of paper into the machine, i.e. as long as only an edge strip of the web of paper travels through the press nip 8, the distance A can temporarily be set to zero. Normal continuous operation with the distance A equal to zero is also possible under certain circumstances.

Figure 3:
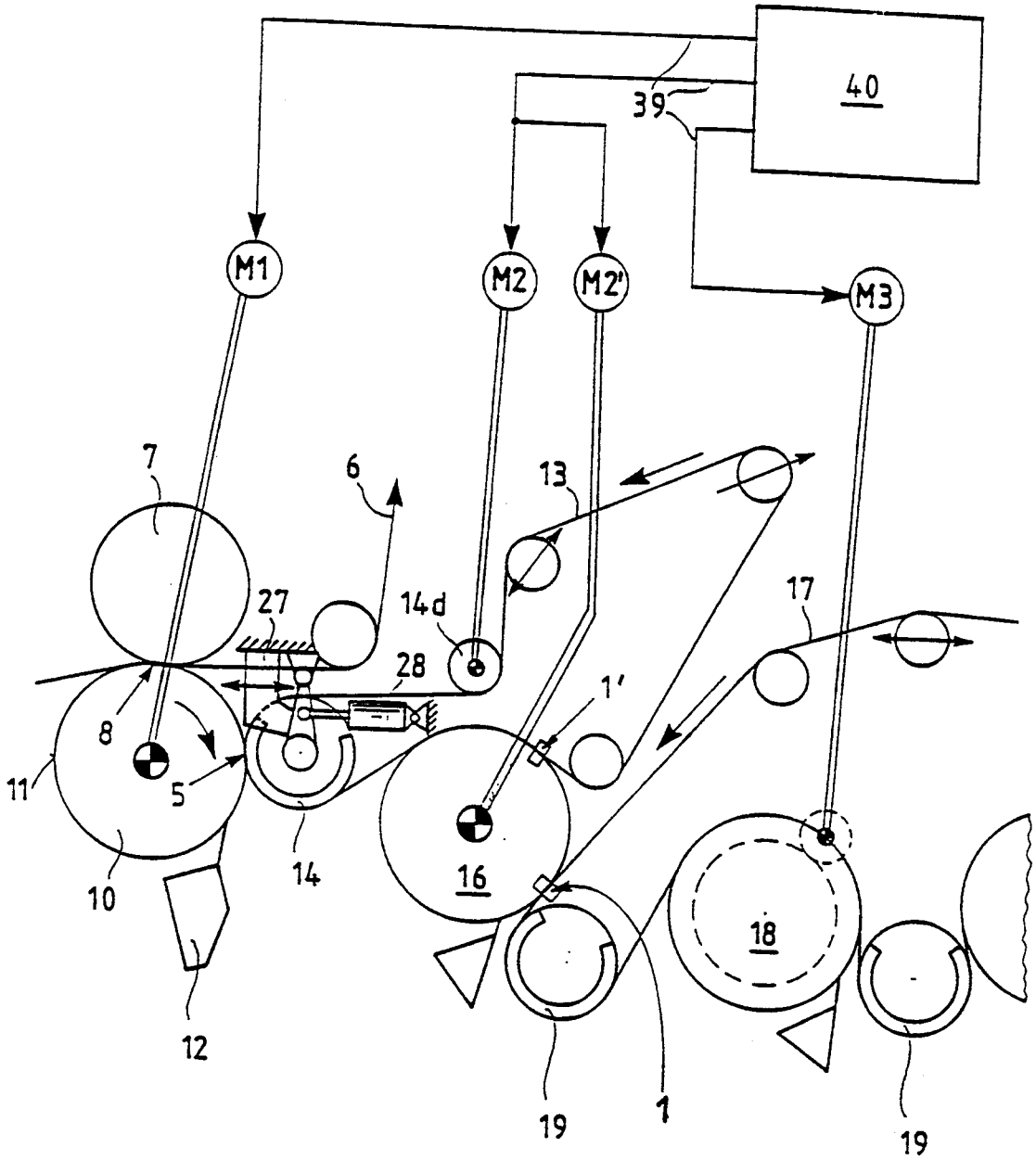
FIGS. 3 and 4 show different embodiments in which the bottom of the web comes into contact with a smooth press roll.

The embodiment shown in FIG. 3 has a lower smooth press roll 10 so that after the web of paper leaves the press nip 8, the web travels downward to its place of removal 5. At that place, once again, there is a suction guide roll 14 for a transport belt 13. The direction of travel of the belt 13 is, however, opposite that of FIGS. 1 and 2. In the operating condition shown, the distance between the rolls 10 and 14 is equal approximately to zero. Another difference from FIGS. 1 and 2 is that, following the suction guide roll 14, the transport belt 13 first travels over a smooth roll 16, which lies outside the loop of the transport belt, or over a so called "predrying cylinder", which, if necessary, can be heated. The paper web which is transferred from the transport belt 13 to this smooth roll 16 detaches from the transport belt at the place 1' where the transport belt travels off from the smooth roll. From here, the web of paper passes, along with the shell of the smooth roll, up to a transfer place 1 where the support belt 17 of the dry end takes the web over and, similar to FIG. 2, feeds it via a first reversal suction roll 19 to the first drying cylinder 18. As in FIGS. 1 and 2, a drive M2 for one of the transport belt guide rolls **14*d* is provided. In addition, a drive M2' is provided for the smooth roll 16. It is obvious that the two rolls 14*d* and 16 drive the transport belt 13 with the same circumferential speed. The differences in speeds a and b can be set, in accordance with FIG. 5, to different values, as was explained above with respect to FIG. 1**.

Figure 4:
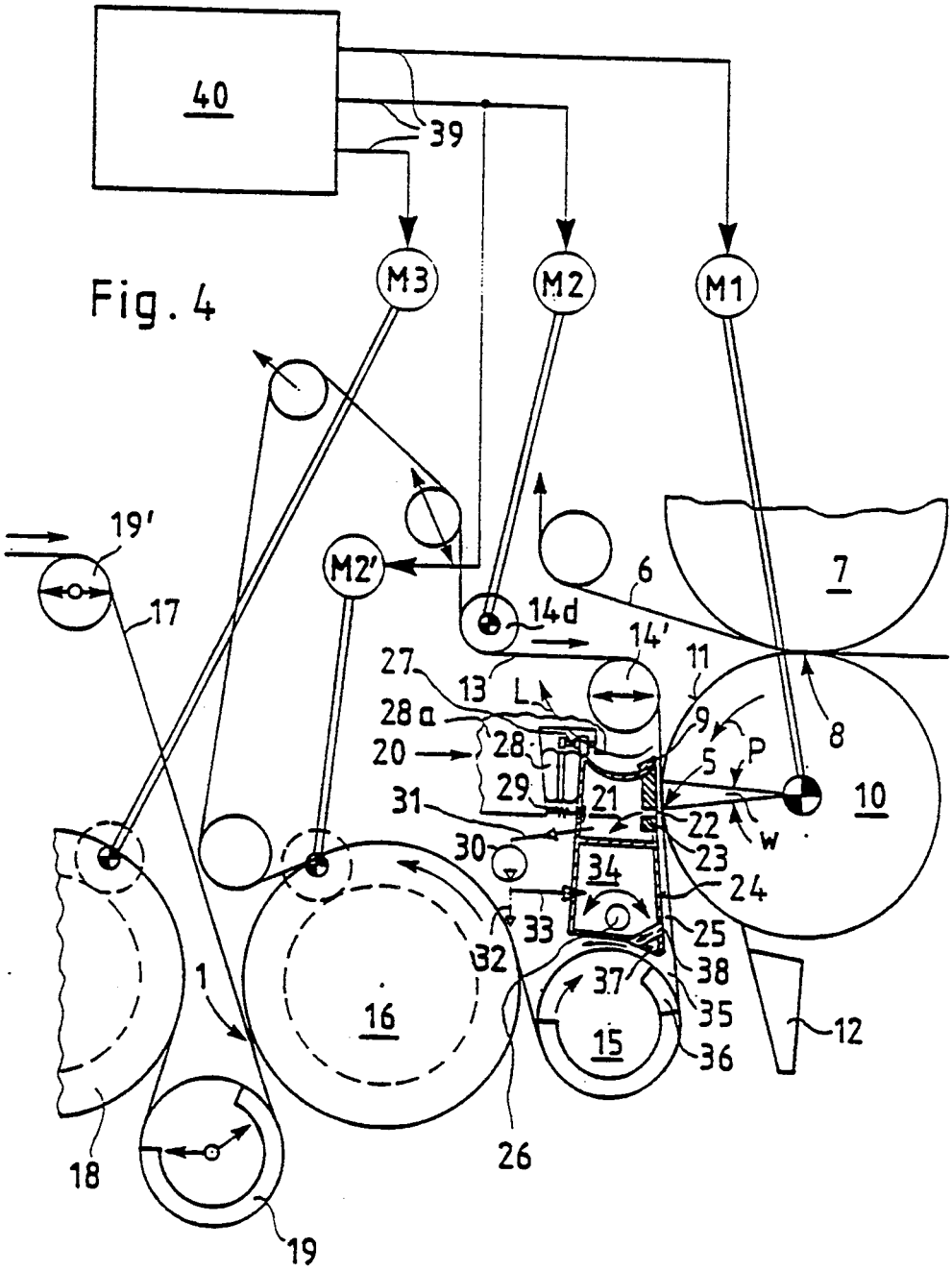

In FIG. 4, the fiber web travels again downward in the direction towards the place of removal 5. In the lower region of the press roll 10 a scraper 12 is present, as is customary. Shortly before the place of removal 5, a porous transport belt 13 travels onto the press roll 10. The transport belt 13 is guided by a horizontally displaceable guide roll 14' lying above the place of removal 5 and then is guided below the place of removal 5 by a suction guide roll 15. The transport belt 13 therefore forms a small angle of wrap w with the press roll 10. The size of that angle can be varied by horizontal displacement of the guide roll 14'. The angle of wrap w may also be adjusted to zero. The transport belt 13 takes the fiber web over at the place of removal 5 and conducts it over the suction guide roll 15 to a smooth roll or "predrying cylinder" 16. The transport belt 13, which forms an endless belt loop, then travels back to the guide roll 14'.

A suction box designated generally 20 is arranged at the place of removal 5, within the endless belt loop of the transport belt 13. In its upper region, the box has a suction chamber 21 with at least one suction slot 22 which lies as close as possible to the place of removal 5. The suction slot is located in the region of a predominantly flat slide surface 23 over which the transport belt 13 slides.

Adjoining the slide surface 23, there is a guide surface 24, which is also predominantly flat and diverges at a small angle from the direction of travel of the transport belt 13. This part of the suction box 20 therefore has the effect of a so-called web stabilizer. In other words, a vacuum is produced in operation by the traveling transport belt 23 in the wedge shaped space 25 between the guide surface 24 and the transport belt 13. This vacuum becomes greater as the operating speed of the paper manufacturing machine becomes faster. The speed is on the order of magnitude of between 500 and 2000 m/min. The guide surface 24 extends up into the entrance wedge 35 between the suction guide roll 15 and the belt 13.

Between the place of removal 5 and the suction guide roll 15, a vacuum is therefore continuously exerted on the fiber web through the transport belt 13 and this pulls the fiber web against the transport belt. Since this path of travel is at least predominantly linear, no (and in any event no substantial) centrifugal force acts in this region on the fiber web.

The suction box 20 is swingably supported on a mount 26. The mount 26 is arranged in the lower region of the suction box so that a distance between the slide surface 23 and the surface 11 of the press roll 10 can be established in the upper region. For this purpose, an adjustable stop 27 is provided on both ends of the suction box 20. The suction box is pressed against that stop by a pneumatic, and therefore resilient, reciprocating device 28. The reciprocating device 28 is supported on a fixed structural part **28*a* with which the stop 27 (which can be developed as a screw) also comes into contact. In addition, a tension spring 29 can be provided which opposes the direction of the stroke. In this way, the pressing force thereof is reduced. Thus, the suction box 20 can easily move away if a foreign body should approach the place of removal 5 together with the fiber web. In this connection, the slide surface 23 can be provided with a rounding (not shown) in front of the suction slot 22. The air-boundary layer entrained by the transport belt 13 is deflected upward (arrow L) by a stripping ledge 9, consisting for instance of felt, which is arranged on the top of the suction box 20**.

A suction line 31 is also diagrammatically shown, which is connected to the suction chamber 21 and a suction blower 30. The blower can convey the air drawn off into the atmosphere, line 32, or via a pressure line 33 into a blast chamber 34 attached to the suction box. The blast chamber 34 forms the guide surface 24 and, if necessary, forms a blast slot 37 in order further to increase the vacuum in the space 25. The direction of its blast is opposite the direction of travel of the suction guide roll 15 and, by an ejector effect, it increases the vacuum present in the wedge 35.

In addition, starting from the guide surface 24, channels 38 can be provided which extend transversely through the blast chamber 34. In this way, the vacuum prevailing in the space 25 can be further increased. The air emerging from the blast nozzle 37 is drawn off again by a pre-suction zone 36 of the suction guide roll 15. In other words, dependable drawing of the web against the transport belt is assured also at the place where the transport belt 13 runs onto the suction guide roll 15.

Figure 6:
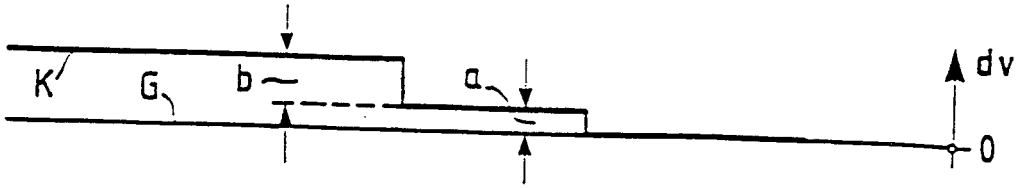
FIG. 6 shows a speed diagram referring to FIG. 4.

As in the other Figures, a first drive M1 for the press roll 10 is provided, as well as a second drive M2 for a transport belt guide roll **14*d*, with an additional drive M2' for the smooth roll 16, and a third drive M3 for the dryer group 17–19. The speed of the second drive M2 is greater, in accordance with FIG. 6, by a small amount than that of the first drive M1. The speed of the third drive M3 is larger by a relatively large amount b than that of the second drives M2 and M2'**.

The guide roll 19', which feeds the support belt 17 to the transfer place 1 and therefore to the smooth roll 16 or the "pre-drying cylinder" 16, or the reversal suction roll 19 is displaceable so that the distance between the roll 16 and the support belt 17 is variable, or so that a small wrap zone can be formed.

The following applies with reference to FIGS. 3 and 4: If the roll 16 is heated and thus is used as a "pre-drying cylinder", a thin layer of vapor is formed between the surface of the shell and the web of paper, so that the web of paper detaches itself from the surface of the shell already before the transition place 1 is reached. This assures that the pretensioning of the paper web and thus the stretching in longitudinal direction, due to the difference in speed b between the drives M3 and M2/M2', does not take place abruptly at the place of transfer 1 but, rather, extends over a relatively long path of travel of the web, for instance, between the places 1' and 1 in FIG. 3.

Figure 7:
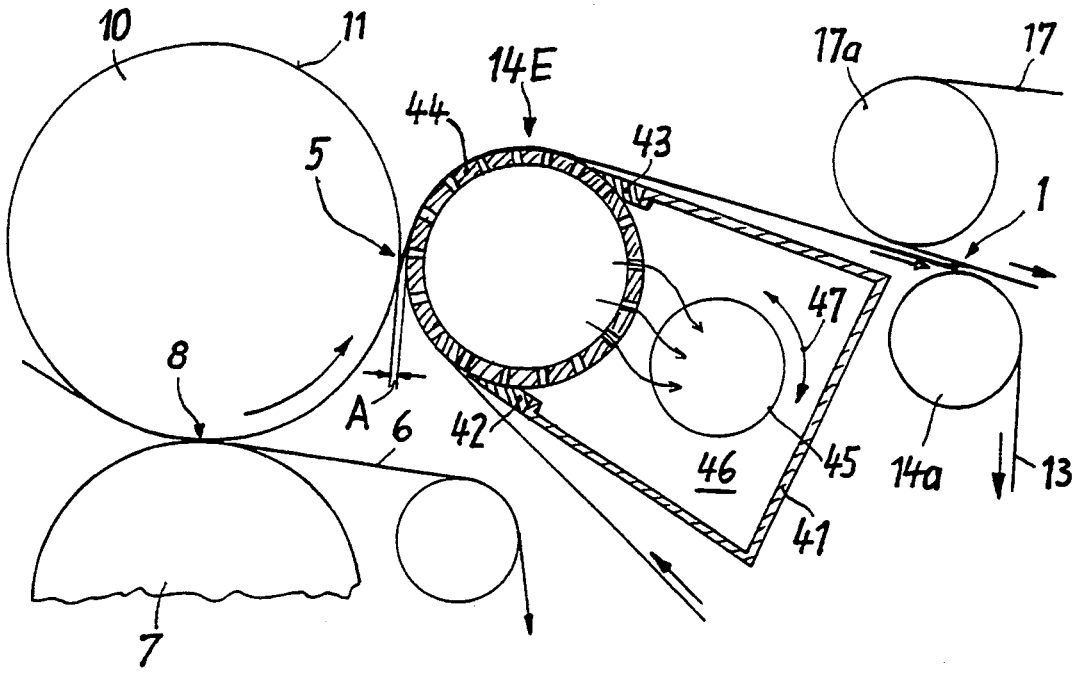
FIG. 7 shows another modification of FIG. 1, in which a suction guide roll has an external suction box.

FIG. 7 shows a modification of FIG. 1. In FIG. 1, suction guide roll 14 has an internal stationary suction box which defines, as is customary, a symbolically shown suction zone. In FIG. 7, suction guide roll 14E has an external suction box 41 which is positioned (like the roll 14E itself) within the loop of transport belt 13. Box 41 has sealing strips 42, 43 which slightly contact the circumference of the perforated roll shell 44. A suction line 45 is connected to at least one of the two front walls 46 of box 41. In order to vary the distance A, box 41 and roll 14E may be commonly shiftable, e.g. around the axis of suction line 45, as indicated by double-arrow 47.

All other details of the embodiment of FIG. 7 as well as its function are identical to that of FIG. 1. In both cases, the negative pressure generated in the perforations of roll shell 44 pulls the fiber web from the smooth surface 11 of press roll 10 onto the transport belt 13.

Figure 8:
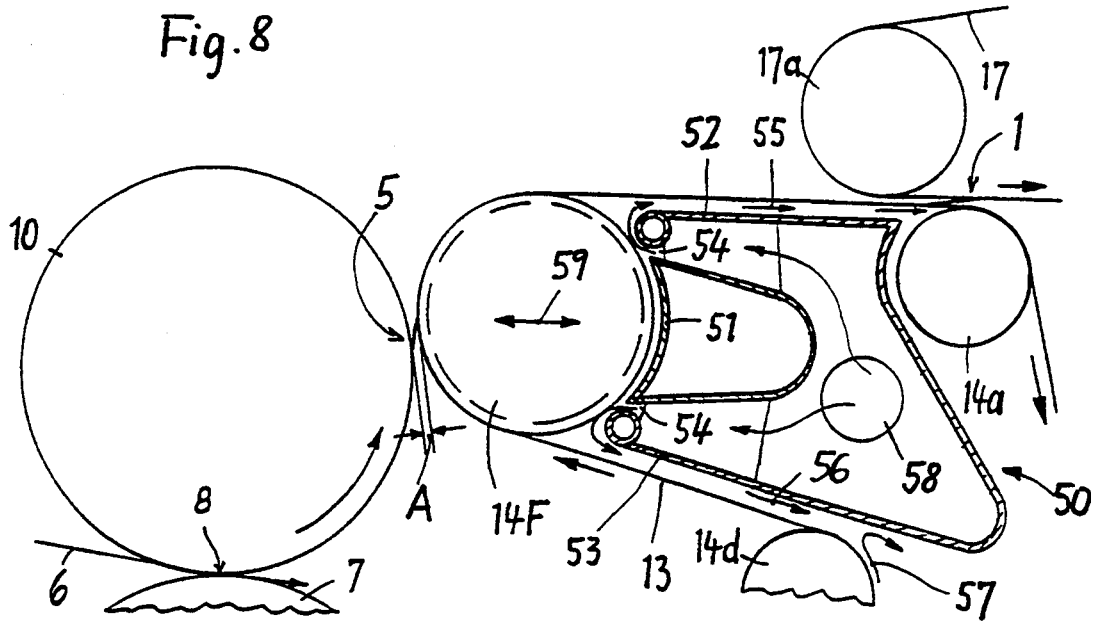
FIG. 8 shows a further modification of FIG. 1 in which a belt guiding device is a grooved guide roll.

FIG. 8 shows a further modification of FIG. 1. Suction guide roll 14 of FIG. 1 is now replaced with a grooved guide roll 14F. The circumferential grooves are indicated by a dash-line circle. As in U.S. Pat. No. 4,677,762, a blow box 50 is disposed within the loop of transport belt 13 and adjacent to roll 14F. The shape of blow box 50 is adapted to the space between rolls 14F, **14*a* and 14*d* and the transport belt 13 travelling across these rolls. In particular, blow box 50 has a concave wall 51 which is adjacent and approximately parallel to the circumference of roll 14F. Connected to wall 51 are two side walls 52, 53 each being approximately parallel to belt 13 travelling from roll 14*d* to roll 14F and from roll 14F to roll 14*a*, respectively. The concave wall 51 comprises at least one air blowing nozzle 54 in the form of a slot which extends parallel to the axis of roll 14F. If two nozzles 54 are provided, the connections between wall 51 and side walls 52, 53 may be rounded. In that way, nozzles 54 may be formed as conventional Coanda nozzles, as shown in FIG. 8. An air inlet is shown at 58. Each nozzle 54 directs an air flow approximately tangential to the circumference of roll 14F and thus induces a negative pressure in the grooves. That negative pressure again pulls the web against belt 13. If Coanda nozzles are provided, the air flow is directed to flow then along the side walls 52, 53. The air flow 55 arriving at roll 14*a* helps to transfer the web (at 1) from belt 13 (which is porous) to belt 17. The air flow 56 arriving at roll 14*d* deflects the air boundary layer 57 which is carried by belt 13. Roll 14F alone or roll 14F together with blow box 50 is shiftable (as indicated by double arrow 59**) in order to vary distance A.

In FIGS. 7 and 8, the drives M1–M3 explained with reference to FIG. 1 are not shown, but they work in the same way.

Figure 9:
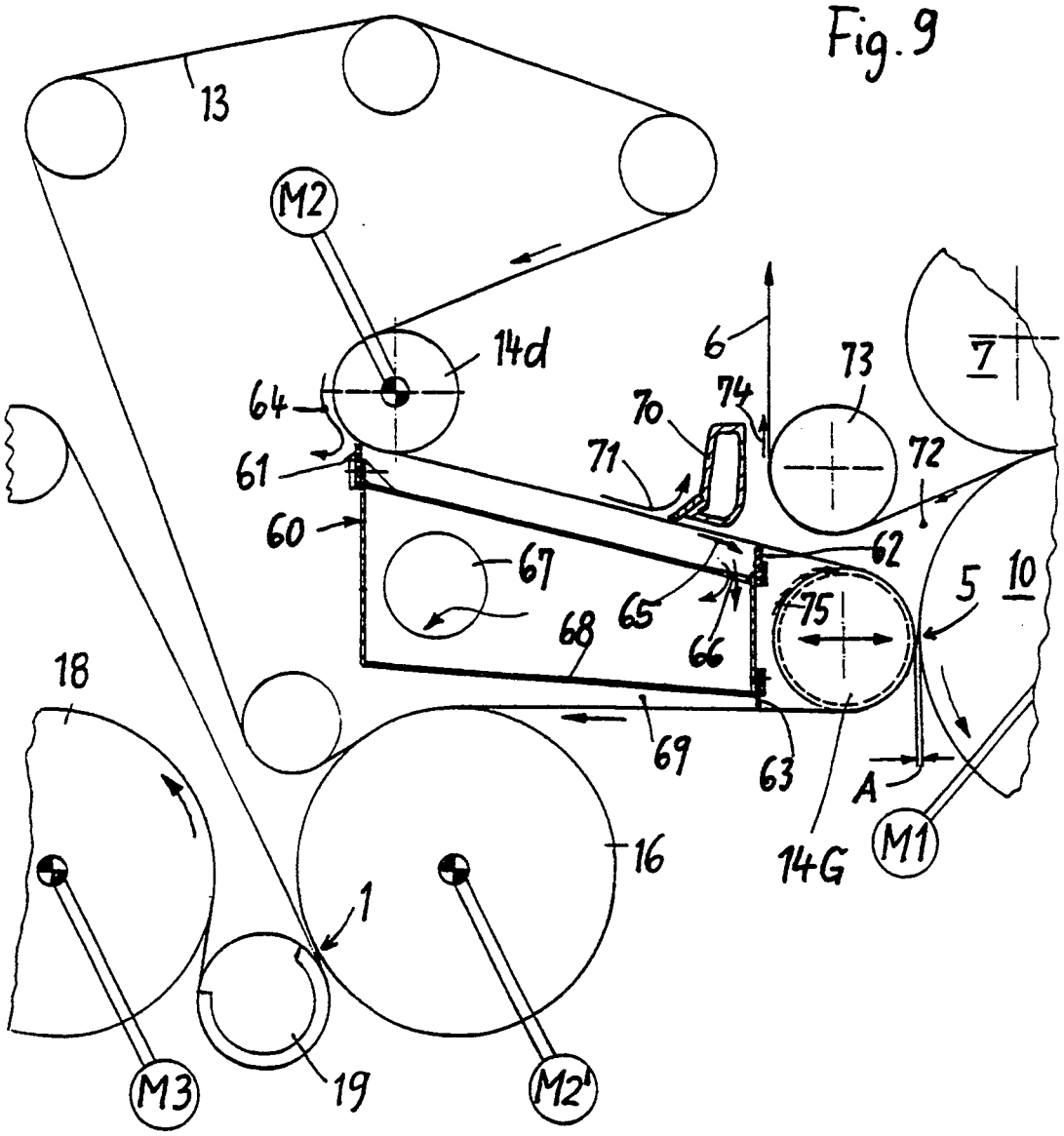
FIG. 9 shows a modification of FIG. 4, which employs a grooved guide roll and an air guide box for guiding a belt.

FIG. 9 shows a modification of FIG. 4. Rolls 14' and 15 as well as suction box 20 of FIG. 4 are now replaced with a grooved guide roll 14G and an air guide box 60. Roll 14G is again disposed close to press roll 10 with distance A being adjustable.

Air guide box 60 is adapted to the space between rolls **14*d*, 14G and 16 and belt 13 travelling across these rolls. Box 60 carries sealing strips 61, 62, 63 which slightly contact belt 13. Strip 61 is an air deflector and is arranged close to roll 14*d* and deflects air flow 64 entrained by belt 13. Strip 62 is arranged where belt 13 approaches roll 14G and directs air flow 65 through openings 66 into the interior of box 60. The air is discharged via outlet 67 which may or may not be connected to a source of negative pressure. Strip 63 is arranged where belt 13 leaves roll 14G and defines together with bottom wall 68 of box 60 and with belt 13 a diverging gap 69 wherein a negative pressure is generated by the travelling belt 13 in order to hold the web at the bottom side of belt 13. A further strip or "deflector" 70 may be arranged outside the loop of belt 13 downstream of roll 14*d* in order to deflect air flow (or boundary layer) 71, so that it cannot enter space 72 between roll 14G and the felt belt 6 travelling from press 7, 10 across felt roll 73. Felt belt 6 entrains an air flow 74 to leave space 72. Thus, deflector 70 and felt belt 6 make it possible to avoid any overpressure in space 72; possibly a slight negative pressure is produced. Air flow 75 produced by grooved roll 14G** itself is easily absorbed by the grooves.

At least some of the measures described above are needed to obtain a quiet and non-fluttering web travel from press roll 10 to transport belt 13 although no suction device or blow box is present.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for transferring a paper web from a press section into a dry end of a paper making machine, the device comprising:

the press section including a rotatable press surface and a cooperating backing roll which together define a press nip through which the web is directed, the press surface being a smooth rotatable press surface for carrying the web thereon through the press nip and then for continuing to carry the web thereon to a further location around the rotating press surface, beyond the press nip, which is at the region of web removal from the press surface;

a suction device located near the press surface and forming a slot with the press surface in the region of web removal;

a porous transport belt, first guide means for guiding the transport belt through the slot between the rotating smooth press surface and the suction device, the transport belt being adapted to receive the web from the smooth press surface and for transporting the web away from the region of web removal;

the dry end comprising a first dryer group comprised of a row of first drying cylinders, a support belt which has a first surface that faces toward the first drying cylinders and that supports a web for a first surface of the web to contact with the first drying cylinders and for then conducting the web from each first drying cylinder to the next first drying cylinder; second guide means for guiding the support belt toward the transport belt to enable the web to be transferred therebetween;

transfer means for transferring the web from the transport belt to the support belt, as the support belt is moving toward the first dryer group for bringing the web to the first drying cylinders;

a first drive for the rotating the smooth press surface which forms the press nip;

a second drive, independent of the first drive, for driving the transport belt to move;

a third drive, independent of the first and the second drives, and connected with the first dryer group for driving the first drying cylinders to rotate;

speed control means connected with the first, second and third drives for establishing the respective speeds of the drives to achieve selected speed differences, wherein the first and second drives are adjustable for establishing a positive difference in speed wherein the second drive moves the transport belt faster than the first drive rotates the press surface, and wherein the third drive is adjustable to establish a positive difference of speed with respect to the second drive, wherein the third drive moves the support belt for the web at a greater speed than the transport belt is driven by the second drive.

2. The device of claim 1, wherein the speed control means is adapted for adjusting the speeds of the drives to produce a small positive difference in speed between the first and second drives and a larger positive difference in speed between the second and third drives, the second difference being several times larger than the first difference.

3. The device of claim 1, wherein the rotating smooth press surface comprises the surface of a press roll.

4. The device of claim 2, wherein the speed control device is operable for establishing the larger difference in speed between the second and third drives to be in the range of two to five times the small difference in speed between the first and the second drives.

5. The device of claim 1, wherein the smooth press surface and the suction device at the transport belt are spaced apart so that at the shortest distance between them, there is a clear gap between them.

6. The device of claim 5, wherein the suction device is moveable in position to alter the width of the gap between the rotating smooth press surface and the suction device.

7. The device of claim 6, further comprising a stop for engaging the suction device to establish a minimum gap distance between the smooth press surface and the suction device.

8. The device of claim 7, further comprising a resilient reciprocating device acting on the suction device for controlling the force with which the suction device rests against the stop.

9. The device of claim 7, wherein the stop is adjustable in position so that the distance of the gap between the press surface and the suction device can be temporarily set to a width value of zero or greater.

10. The device of claim 6, further comprising web transfer means for causing the web to be transferred from the web transport belt to the support belt.

11. The device of claim 1, wherein the second guide means for the support belt and the first guide means for the transport belt respectively support the support belt and the transport belt so that they move in the same direction of travel over a web transfer place, the web is supported on the side of the transport belt which is toward the side of the support belt traveling thereby; the first and second guide means supporting the transport belt and the support belt, respectively, to be separated by a gap between them as they move in the same direction of travel past the web transfer place.

12. The device of claim 11, further comprising means enabling adjustment of the gap between the transport belt and the support belt as they travel past the web transfer place.

13. The device of claim 11, further comprising an additional suction device at the support belt located at the web transfer place for suction transferring the web from the transport belt to the support belt at the web transfer place.

14. The device of claim 1, further comprising a smooth rotatable roll lying outside the loop of the transport belt and the smooth roll having a surface and being located for the transport belt surface with the web thereon to contact the smooth roll with the transport belt over a part of the surface of the smooth roll; the smooth roll having another part of the surface thereof which is free of the transport belt, and the smooth roll being adapted to receive the web from the transport belt and to transport the web on the smooth surface thereof;

the support belt engaging the surface of the smooth roll at a location away from the contact by the transport belt upon the smooth roll, and the support belt being adapted to pick up the web from the smooth surface of the roll to carry the web on the support belt toward the first dryer group.

15. The device of claim 14, further comprising a suction device within the loop of the support belt and at a slight distance from the smooth roll and over which the support belt passes after it has left the smooth roll, the suction device being placed between the smooth roll and the first drying cylinder of the first dryer group in the path of the support belt, such that the web travels on the outside of the web past the suction device to the first drying cylinder of the first dryer group.

16. The device of claim 15, wherein the suction device comprises a suction roll within the loop of the support belt.

17. A device for transferring a paper web from a press section into a dry end of a paper making machine, the device comprising:

the press section including a rotatable press surface and a cooperating backing roll which together define a press nip through which the web is directed, the press surface being a smooth rotatable press surface for carrying the web thereon through the press nip and then for continuing to carry the web thereon to a further location around the rotating press surface, beyond the press nip, which is at the region of web removal from the press surface;

a belt guiding device located near the press surface and forming a slot with the press surface in the region of web removal;

a porous transport belt, first guide means for guiding the transport belt through the slot between the rotating smooth press surface and the belt guiding device, the transport belt being adapted to receive the web from the smooth press surface and for transporting the web away from the region of web removal;

the dry end comprising a first dryer group comprised of a row of first drying cylinders, a support belt which has a first surface that faces toward the first drying cylinders and that supports a web for a first surface of the web to contact with the first drying cylinders and for conducting the web from each first drying cylinder to the next first drying cylinder; second guide means for guiding the support belt toward the transport belt to enable the web to be transferred therebetween;

transfer means for transferring the web from the transport belt to the support belt, as the support belt is moving toward the first dryer group for bringing the web to the first drying cylinders;

a first drive for the rotating the smooth press surface which forms the press nip;

a second drive, independent of the first drive, for driving the transport belt to move;

a third drive, independent of the first and the second drives, and connected with the first dryer group for driving the first drying cylinders to rotate;

speed control means connected with the first, second and third drives for establishing the respective speeds of the drives to achieve selected speed differences, wherein the first and second drives are adjustable for establishing a positive difference in speed wherein the second drive moves the transport belt faster than the first drive rotates the press surface, and wherein the third drive is adjustable to establish a positive difference of speed with respect to the second drive, wherein the third drive moves the support belt for the web at a greater speed than the transport belt is driven by the second drive.

18. The device of claim 17, wherein the speed control means is adapted for adjusting the speeds of the drives to produce a small positive difference in speed between the first and second drives and a larger positive difference in speed between the second and third drives, the second difference being several times larger than the first difference.

19. The device of claim 17, wherein the rotating smooth press surface comprises the surface of a press roll.

20. The device of claim 18, wherein the speed control device is operable for establishing the larger difference in speed between the second and third drives to be in the range of two to five times the small difference in speed between the first and the second drives.

21. The device of claim 17, wherein the smooth press surface and the belt guiding device at the transport belt are spaced apart so that at the shortest distance between them, there is a clear gap between them.

22. The device of claim 21, wherein the belt guiding device is moveable in position to alter the width of the gap between the rotating smooth press surface and the belt guiding device.

23. The device of claim 22, further comprising a stop for engaging the belt guiding device to establish a minimum gap distance between the smooth press surface and the belt guiding device.

24. The device of claim 23, further comprising a resilient reciprocating device acting on the belt guiding device for controlling the force with which the belt guiding device rests against the stop.

25. The device of claim 23, wherein the stop is adjustable in position so that the distance of the gap between the press surface and the belt guiding device can be temporarily set to a width value of zero or greater.

26. The device of claim 22, further comprising web transfer means for causing the web to be transferred from the web transport belt to the support belt.

27. The device of claim 17, wherein the second guide means for the support belt and the first guide means for the transport belt respectively support the support belt and the transport belt so that they move in the same direction of travel over a web transfer place, the web is supported on the side of the transport belt which is toward the side of the support belt traveling thereby; the first and second guide means supporting the transport belt and the support belt, respectively, to be separated by a gap between them as they move in the same direction of travel past the web transfer place.

28. The device of claim 27, further comprising means enabling adjustment of the gap between the transport belt and the support belt as they travel past the web transfer place.

29. The device of claim 27, further comprising an additional suction device at the support belt located at the web transfer place for suction transferring the web from the transport belt to the support belt at the web transfer place.

30. The device of claim 17, further comprising a smooth rotatable roll lying outside the loop of the transport belt and the smooth roll having a surface and being located for the transport belt surface with the web thereon to contact the smooth roll with the transport belt over a part of the surface of the smooth roll; the smooth roll having another part of the surface thereof which is free of the transport belt, and the smooth roll being adapted to receive the web from the transport belt and to transport the web on the smooth surface thereof;

the support belt engaging the surface of the smooth roll at a location away from the contact by the transport belt upon the smooth roll, and the support belt being adapted to pick up the web from the smooth surface of the roll to carry the web on the support belt toward the first dryer group.

31. The device of claim 30, further comprising a suction device within the loop of the support belt and at a slight distance from the smooth roll and over which the support belt passes after it has left the smooth roll, the suction device being placed between the smooth roll and the first drying cylinder of the first dryer group in the path of the support belt, such that the web travels on the outside of the web past the suction device to the first drying cylinder of the first dryer group.

32. The device of claim 31, wherein the suction device comprises a suction roll within the loop of the support belt.

33. The device of claim 17, wherein the belt guiding device is a suction roll.

34. The device of claim 17, wherein the belt guiding device is a suction box.

35. The device of claim 17, wherein the belt guiding device comprises a perforated roll having an external suction box disposed for applying suction to the perforated roll.

36. The device of claim 35, wherein the perforated roll is movable in position to alter the width of the gap between the rotating smooth press surface and the suction device.

37. The device of claim 17, wherein the belt guiding device comprises a grooved roll with a blow box having a blowing nozzle structured and arranged adjacent to the grooved roll so as to generate a negative pressure in the grooves thereof.

38. The device of claim 37, further comprising at least one air deflector arranged close to the transport belt and upstream of the grooved roll.

* * * * *